US011830666B2

(12) United States Patent
Pacheco et al.

(10) Patent No.: US 11,830,666 B2
(45) Date of Patent: Nov. 28, 2023

(54) TANK FOR LIQUID-FILLED SHELL TRANSFORMERS OR SHELL REACTORS

(71) Applicant: HITACHI ENERGY LTD, Zürich (CH)

(72) Inventors: Pablo Pacheco, Cordova (ES); Miguel Cuesto, Seville (ES); Miguel Aguirre, Cordova (ES)

(73) Assignee: HITACHI ENERGY LTD, Zürich (CH)

( * ) Notice: Subject to any disclaimer, the term of this patent is extended or adjusted under 35 U.S.C. 154(b) by 512 days.

(21) Appl. No.: 16/978,837

(22) PCT Filed: Mar. 5, 2019

(86) PCT No.: PCT/EP2019/055395

§ 371 (c)(1),
(2) Date: Sep. 8, 2020

(87) PCT Pub. No.: WO2019/170642

PCT Pub. Date: Sep. 12, 2019

(65) Prior Publication Data

US 2021/0043370 A1 Feb. 11, 2021

(30) Foreign Application Priority Data

Mar. 7, 2018 (EP) ..... 18382142

(51) Int. Cl.
*H01F 27/02* (2006.01)
*H01F 27/32* (2006.01)
*H01F 41/02* (2006.01)

(52) U.S. Cl.
CPC ..... *H01F 27/321* (2013.01); *H01F 27/022* (2013.01); *H01F 27/327* (2013.01); *H01F 41/02* (2013.01)

(58) Field of Classification Search
CPC .... H01F 27/321; H01F 27/022; H01F 27/327; H01F 41/02; H01F 27/02; H01F 27/14
See application file for complete search history.

(56) References Cited

U.S. PATENT DOCUMENTS

2011/0147115 A1 6/2011 Ertl

FOREIGN PATENT DOCUMENTS

CN 205230706 U 5/2016
JP S41-4104 Y 3/1941
(Continued)

OTHER PUBLICATIONS

International Search Report and Written Opinion of the International Searching Authority, PCT/EP2019/055395, dated May 7, 2019, 10 pages.

(Continued)

*Primary Examiner* — Tuyen T Nguyen
(74) *Attorney, Agent, or Firm* — Sage Patent Group

(57) ABSTRACT

A tank for a liquid-filled shell transformer or shell reactor is disclosed. It comprises a lower tank portion with a bottom plate and side walls, and an upper tank portion with side walls. The upper and lower tank portions are joined together along a substantially horizontal perimetric joining line and define an internal space for housing an active part of the shell transformer or shell reactor and an insulating liquid. The tank further comprises a reinforcing cincture surrounding and joined to the side walls of the lower tank portion and the upper side walls of the upper tank portion and forming a sealed chamber enclosing the perimetric joining line between the lower tank portion and the upper tank portion. A shell transformer or reactor provided with such a tank is also disclosed, as well as a method for assembling a shell transformer or reactor.

20 Claims, 5 Drawing Sheets

(56) References Cited

FOREIGN PATENT DOCUMENTS

| | | | | |
|---|---|---|---|---|
| JP | 5077827 | A | | 6/1975 |
| JP | S5278020 | A | | 7/1977 |
| JP | 53-152128 | U | * | 11/1978 |
| JP | S56161619 | A | | 12/1981 |
| JP | 5521112 | A | | 12/1983 |
| JP | S6041208 | A | | 3/1985 |
| JP | H10270257 | A | | 10/1998 |
| JP | 2012062990 | A | | 3/2012 |
| JP | 2015018995 | A | | 9/2017 |
| KR | 20150023639 | A | | 3/2015 |
| KR | 20170126852 | A | | 11/2017 |

OTHER PUBLICATIONS

Japanese Notice of Reasons for Refusal, JP2020-544635, dated Mar. 4, 2021, 4 pages.

Kawamura et al., "Prevention of Tank Rupture Due to Internal Fault of Oil-Filled Transformer", Cigre, International Conference on Large High Voltage Electric Systems, 1988 Session, Aug. 28-Sep. 3, 112, boulevard Haussmann—75008 Paris, 9 pages.

Culver et al., "Prevention of Tank Rupture of Faulted Power Transformers by Generator Circuit Breakers", ETEP vol. 6, No. 1, Jan./Feb. 1996, pp. 39-45.

Petersen et al., "Guide for Transformer Fire Safety Practices", Cigre, Working Group A2.33, Jun. 2013, 139 pages.

* cited by examiner

TANK FOR LIQUID-FILLED SHELL TRANSFORMERS OR SHELL REACTORS

CROSS-REFERENCE TO RELATED APPLICATIONS

The present application is a 35 U.S.C. § 371 national stage application of PCT International Application No. PCT/EP2019/055395 filed on Mar. 5, 2019, which claims the benefit and priority of EP18382142, filed on 7 Mar. 2018, the disclosure of each which is incorporated by reference in their entireties.

TECHNICAL FIELD

The present disclosure is related to a tank for shell transformers or shell reactors that is filled with an insulating liquid, such as oil.

BACKGROUND ART

Power transformers or reactors may be subject to internal arc energy in case of internal failure. The insulating fluid surrounding the active part of the transformer or reactor may then vaporize and create an expanding gas bubble, causing an overpressure that may break the transformer or reactor tank.

Such an arc fault is more critical in shell-form transformers or shell-form reactors, which have a form-fit tank that mechanically fits around the active part of the transformer/reactor and is more rigid than a tank of core-form technology. The tank of shell transformers or reactors is therefore less flexible and less able to deform without breaking when subject to a high tensile stress. In case of an internal arc, the resulting overpressure will create mechanical stresses in the tank that may exceed the ultimate tensile strength of at least certain regions or parts of the tank, which may thus suffer a non-admissible strain and break, at a low level of energy for internal arcs. The rupture of the tank may cause oil spills and the risk of fire breaking out.

Some solutions have been developed to address the problem of rupture of the tank in case of internal arc fault, especially for core-form transformers. Known solutions involve, for example, pressure relief devices, C-shaped clamps provided at discrete positions to reinforce the welded joint between different parts of the tank (for shell technology) and prevent them from breaking, or reinforcing ribs on the side walls of the tanks, as well as modifications of the tank dimensions.

However, known solutions may not be sufficient to prevent the rupture of the tank of a shell-type transformer or reactor in case of an internal arc fault, so it would be desirable to provide a tank that is safer and in which the risks of rupture is reduced.

SUMMARY OF THE DISCLOSURE

According to a first aspect, a tank for a liquid-filled shell transformer or shell reactor is provided. The tank comprises a lower tank portion with a bottom plate and lower side walls, and an upper tank portion with upper side walls, the lower tank portion and upper tank portion being joined together along a substantially horizontal perimetric joining line and defining an internal space for housing an active part of the shell transformer or shell reactor and an insulating liquid. The tank also comprises a reinforcing cincture surrounding and joined to the lower side walls of the lower tank portion and the upper side walls of the upper tank portion and forming a sealed chamber enclosing the perimetric joining line between the lower tank portion and the upper tank portion.

In case of an overpressure caused by an internal arc in the transformer or reactor, the reinforcing cincture provides a protection of the joint between the two portions of the tank (lower and upper parts). In known tanks this joint is a weak and critic region due to its position and to its lack of flexibility, as usually it is a simply welded joint which does not allow it to deform and accommodate the overpressure without breaking in case of internal arc. Known measures such as the use of some discrete C-shaped clamps applied to the weld are not sufficient in such cases. The reinforcing cincture provides a higher ultimate tensile strength to the tank in the region of the joint and displaces the weakest point to other regions of the tank where the overpressure and the consequent stresses on the tank walls can be more easily accommodated, such as the upper region of the tank.

Furthermore, the reinforcing cincture being configured to form a sealed chamber surrounding the joint between the lower and upper portions of the tank means that even if the primary weld mail fail or break at one or more points due to a very high overpressure and stress, the insulating liquid, for example oil, will be confined in the chamber and will not spill out of the tank thanks to the additional protection. The reinforcing cincture therefore has the additional advantage of protecting the environment from an oil spill and from the risk of fire associated with such an oil spill.

The present disclosure also provides a liquid-filled shell transformer or shell reactor with a tank as disclosed herein.

Embodiments of tanks presented in the present disclosure are suitable for single-phase shell transformers and reactors, but may also be applied in polyphase shell systems, such as three-phase transformers and reactors.

According to a second aspect, the present disclosure provides a method for assembling a liquid-filled shell transformer or shell reactor, comprising:

- providing a lower tank portion and an upper tank portion, configured to be joined to each other along a substantially horizontal perimetric joining line,
- joining a lower reinforcing cincture portion to a side wall of the lower tank portion, and joining an upper reinforcing cincture portion to a side wall of the upper tank portion,
- mounting the active parts of the shell transformer or shell reactor inside the lower tank portion,
- mounting the upper tank portion on the lower tank portion and welding them together along the perimetric joining line, and
- joining together the lower reinforcing cincture portion and the upper reinforcing cincture portion to form a sealed chamber enclosing the perimetric joining line between the lower tank portion and the upper tank portion.

BRIEF DESCRIPTION OF THE DRAWINGS

Particular embodiments of the present device will be described in the following by way of non-limiting examples, with reference to the appended drawings, in which.

DETAILED DESCRIPTION

A tank according to embodiments disclosed herein is suitable and intended for housing the active part of a power transformer or a reactor, and more in particular a shell-form solution. Tanks for shell technology typically comprise a lower tank portion, into which is arranged the winding package, formed by multiple pancakes staked and connected in series. The transformer core is then stacked around the winding package, on the bottom plate of the tank, and an upper tank portion is then set on the lower tank portion surrounding the core and is welded to the lower tank portion. Finally, a tank cover is welded to the top of the upper tank portion, and the rest of the space in the tank is filled with an insulating liquid, such as oil.

Thus, the lower tank portion and upper tank portion define between them an internal space for the shell-form active part (windings, core, etc.) and the insulating liquid. The tank, and therefore the upper and lower tank portions, may be prismatic. Typically it may be a rectangular prism.

In the present disclosure the expressions upper, lower, vertical, horizontal, etc. are given with reference to the intended position of the transformer and the tank when in use.

In the present disclosure, the expression "transformers" is also meant to encompass autotransformers.

Figure 1:
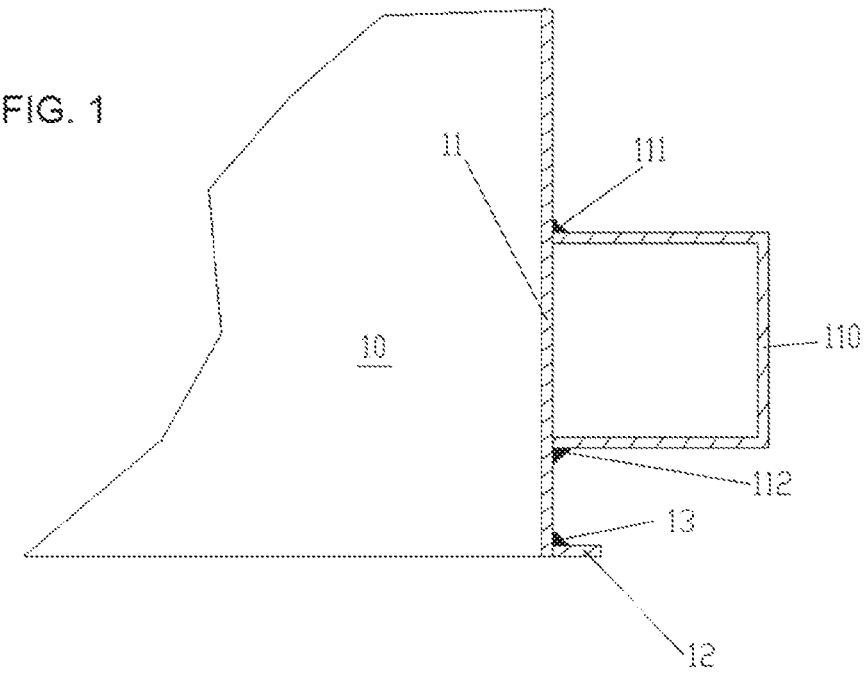
FIGS. 1 and 2 are schematic cross section views of an upper tank portion and of a lower tank portion of a tank according to an example of the present disclosure.

FIG. 1 shows in cross section a detail of an upper tank portion 10, for example of a prismatic tank, which may comprise side walls 11 that are substantially vertical and end in a horizontal flange 12 at the lower end thereof, extending all around the perimeter of the upper tank portion 10. The flange 12 may be welded to the vertical part of the side walls 11 by a weld seam 13 as shown, or may be formed by bending the end portion of the side walls 11.

Joined to the side walls 11 is shown an upper reinforcing ring 110, which may be hollow and may for example have a U-shaped cross section as shown, but also a cross section that is rectangular or has any other shape and dimension. The upper reinforcing ring 110 may project horizontally further from the vertical side wall 11 than the flange 12.

Upper reinforcing ring 110 may surround all the upper tank portion 10 forming a continuous piece, and may be joined to the side walls 11 of the upper tank portion 10 by welding, for example by forming two continuous fillet welds 111 and 112 all around.

Figure 2:
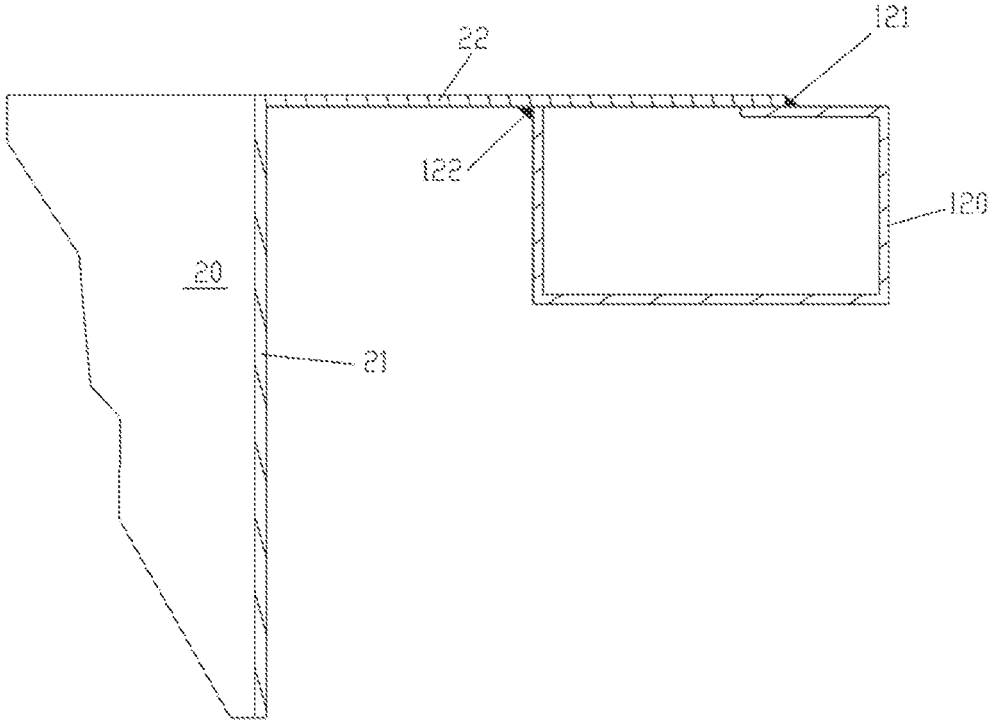

FIG. 2 similarly shows in cross section a detail of a lower tank portion 20, matching the shape of the upper tank portion 10 of FIG. 1 such that both portions can be joined to form a tank for containing an active part, for example of a shell transformer or a shell reactor (not shown).

The lower tank portion 20 may comprise a bottom plate, side walls 21 that are substantially vertical and end in a horizontal flange 22 at the upper end thereof, extending all around the perimeter of the lower tank portion 20. The lower tank portion 20 may have smaller internal horizontal and vertical dimensions with respect to the upper tank portion 10, but the dimensions of the flange 12 of the upper tank portion 10 and of the flange 22 of the lower tank portion 20 may be configured to match and form between them a horizontal perimetric joining line between the upper tank portion 10 and the lower tank portion 20.

Joined to the flange 22 of the side walls 21 is shown a lower reinforcing ring 120, which may be hollow and may for example have a G-shaped cross section as shown, but also a cross section that is rectangular or has any other shape and dimension. The lower reinforcing ring 120 may project horizontally further from the vertical side wall 21 than the horizontal flange 22.

Lower reinforcing ring 120 may surround all the lower tank portion 20 forming a continuous piece, and it may be joined to the flange 22 of the lower tank portion 20 by welding, for example by forming two continuous fillet welds 121 and 122.

Figure 3A:
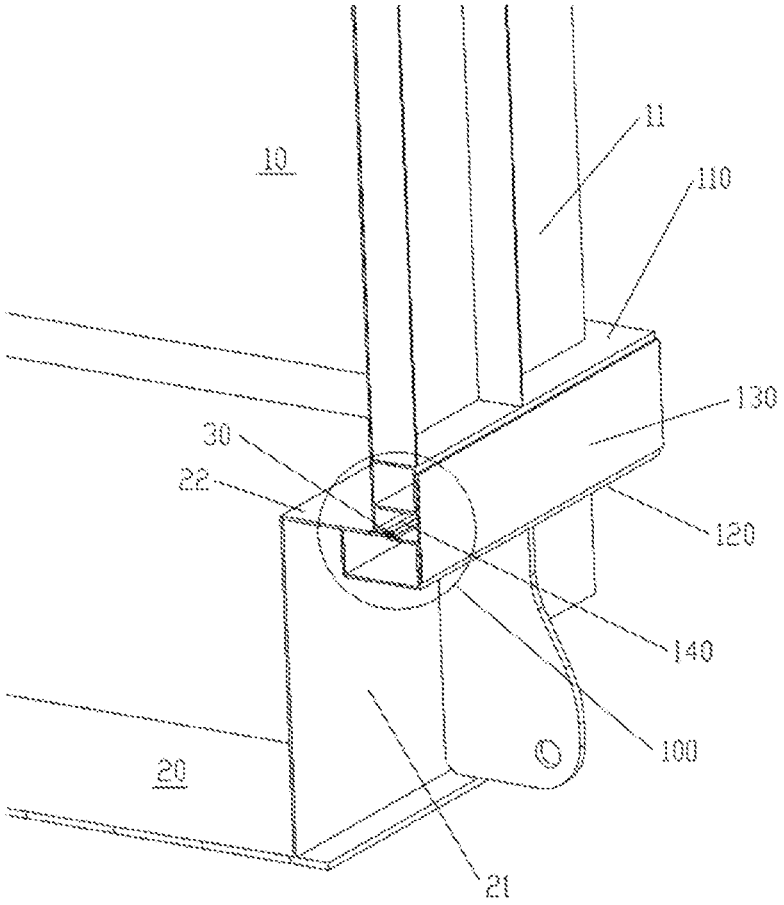
FIG. 3A is a schematic perspective view, partly cut away, showing the region of the joint between the upper tank portion and the lower tank portion of a tank built with the tank portions of FIGS. 1 and 2.

FIG. 3A shows in perspective, partly cut away, the upper tank portion 10 of FIG. 1 and the lower tank portion 20 of FIG. 2 assembled together to form the tank: horizontal flange 12 may be overlapped on horizontal flange 22 and the two flanges may be welded together with a weld seam 30 that joins and seals the two portions 10 and 20 of the tank all around a substantially horizontal perimetric joining line.

As shown in FIG. 3A, a closing plate or belt 130 may be applied against the upper reinforcing ring 110 and lower reinforcing ring 120 and joined to both. For example it may be welded to the beams 110 and 120.

The assembly of upper reinforcing ring 110, lower reinforcing ring 120 and belt 130 forms a reinforcing cincture 100 that surrounds the side walls 11 and 21 of the upper tank portion 10 and the lower tank portion 20, at the level of the perimetric joining line between them; the reinforcing cincture 100 is joined, e.g. welded, to the vertical part of the side walls 11 and to the flange 22 of the side walls 21. The upper reinforcing rings 110 are an embodiment of an upper reinforcing cincture portion, and the lower reinforcing rings 120 are an embodiment of a lower reinforcing cincture portion, which may be joined together, in this case through the closing plate or belt 130.

Figure 3B:
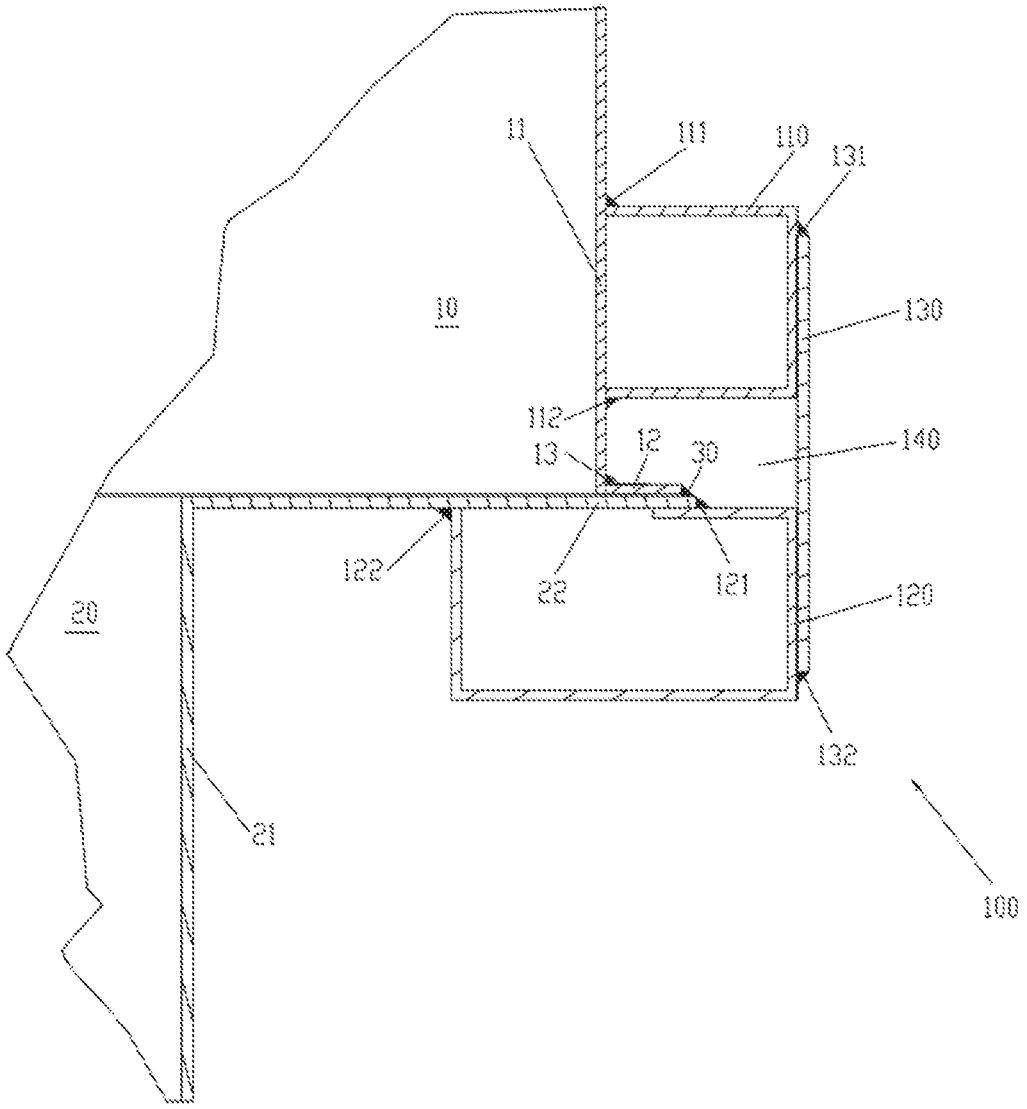
FIG. 3B is an enlarged view in cross section of a detail of FIG. 3A.

FIG. 3B is in enlarged cross section of a detail of FIG. 3A, showing e.g. how the belt 130 may be joined to the upper reinforcing rings 110 and 120 by two continuous fillet welds 131 and 132, respectively.

Belt 130 may be applied surrounding all the tank in a continuous and sealing way.

It will be appreciated in FIGS. 3A and 3B that he reinforcing cincture 100 may form a sealed chamber 140 around the weld seam 30, enclosing all the perimetric joining line between the upper and lower tank portions 110 and 120.

The chamber 140 may be a single, substantially toroidal-like chamber all around the perimeter of the tank, or may be divided in multiple separate compartments for example by vertical plates (not shown).

In other embodiments the reinforcing cincture 100 may also be formed by different reinforcing elements from those described above: for example, it may comprise reinforcing rings with different shapes or having a variable geometry and/or configuration along the perimeter of the tank. For example, in a tank for a shell transformer having short-circuit beams on two opposite sides of the lower tank portion, the lower reinforcing ring may have a different shape on different sides of the lower tank portion, and may be joined to a different part of the lower tank portion, or in a different way. In other examples, reinforcing rings may be formed with non-hollow beams such as I-beams, T-beams or others; the upper and lower reinforcing rings may project different lengths, and/or they may be joined by a closing element different from a belt or closing plate 130; or may have shapes allowing the upper and lower reinforcement rings to form the sealed chamber and be welded to each other without the need for a closing plate or belt.

In other embodiments at least some of the joints, for example one or both the joints between the belt 130 and the reinforcing rings 110 and 120, may be formed by bolting instead of welding.

Figure 4:
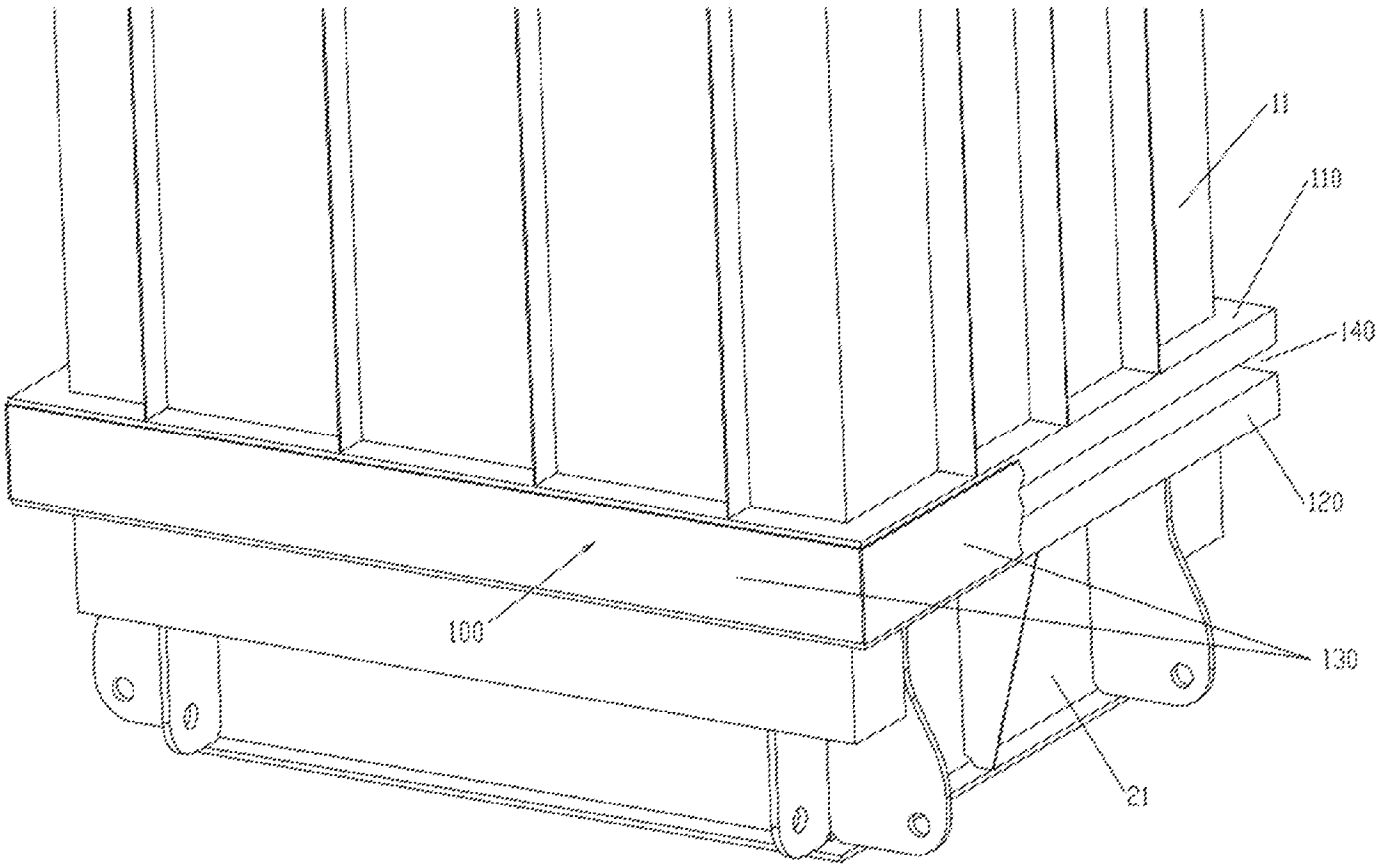
FIG. 4 is a partial perspective view of the lower part of a tank according to an embodiment, showing the reinforcing cincture partially applied to the joint between the two tank portions.

FIG. 4 shows is perspective part of an upper tank portion 10 and a lower tank portion 20, with a reinforcing cincture 100 such as described in detail with reference to FIGS. 1, 2 and 3. The belt 130 of the reinforcing cincture 100 has been partly cut away to show the inside of the sealed chamber 140 behind it.

It will be appreciated from FIGS. 3B and 4 that the reinforcing cincture 100 strengthens and protects the weld seam 30 that joins the two tank portions 110 and 120 together.

A short circuit or a similar failure in the transformer windings may cause an internal arc generating an energy of e.g. 20 MJ. The weld seam 30 between the upper and lower portions of the tank is a weak point and is not able to withstand the resulting overpressure, and would tend to break; however, the reinforcing cincture 100 provides the weld seam region with a higher ultimate tensile strength, such that the weld seam may withstand much higher overpressures without failing and breaking.

Furthermore, in case the weld seam 30 should fail at one or more points of the perimeter of the tank and insulating oil should flow out, the reinforced, sealed chamber 140 would restrain this oil, thus preventing serious hazards such as a spill to the environment and the risk of fire.

In practice, the reinforcing cincture 100 causes a displacement of the weakest point of the tank from the weld seam 30 to other regions of the tank walls, that are more easily configured to absorb energy and deform without arriving to a rupture.

Embodiments of tanks as disclosed herein may additionally be provided with vertical ribs on the side walls 11 of the upper tank portion 10, so that the side walls with the ribs may be built with enough flexibility to absorb arc energy and deform, without reaching rupture. The number, position and configuration of the ribs to provide a suitable compromise between strength and flexibility will depend on each particular case.

The edges between two side walls 11 of the upper tank portion 110 and/or the edges between two side walls 21 of the lower tank portion 120 may be rounded, to better resist the overpressure.

Embodiments of liquid-filled shell transformers or shell reactors may be provided with a tank having a reinforced cincture 100, as disclosed above and as shown in FIG. 4, where the lower part of such a shell transformer or shell reactor is shown.

Figure 5:
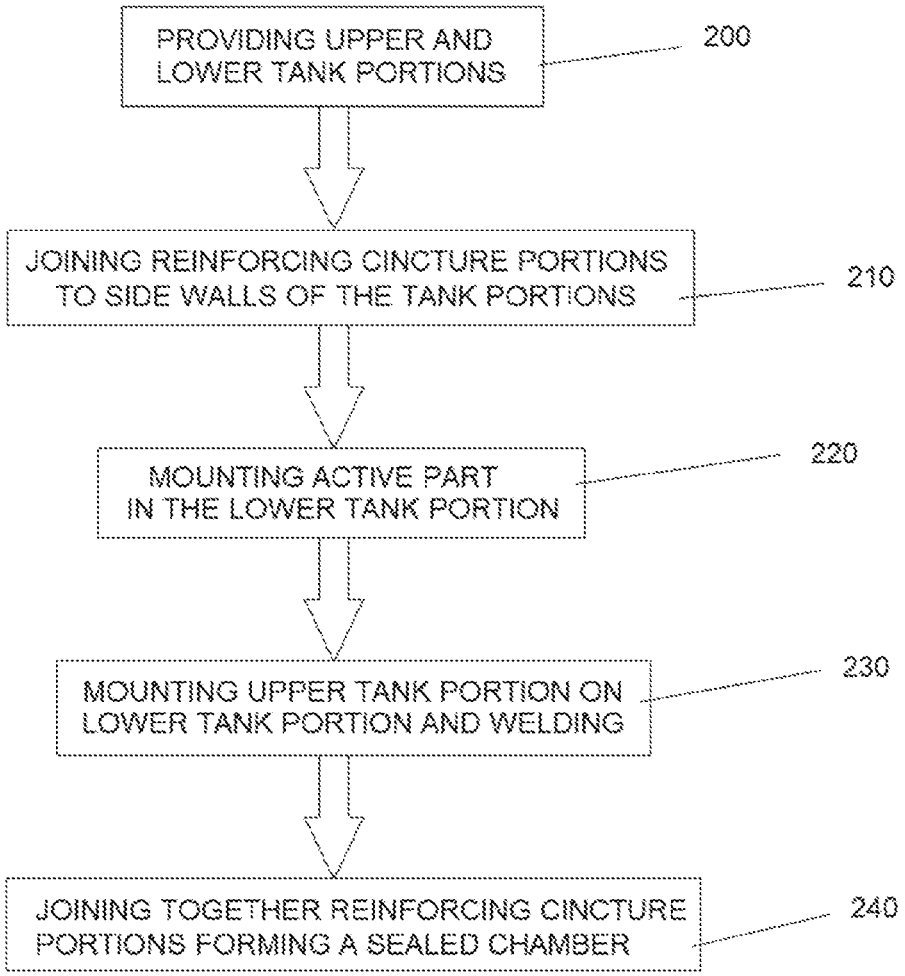
FIG. 5 is a flow diagram illustrating an example of a method for assembling a liquid-filled shell transformer or shell reactor.

A transformer or reactor with a tank according to the present disclosure may be assembled by embodiments of a method comprising, as shown in FIG. 5:

In block 200: providing a lower tank portion 20 and an upper tank portion 10;

In block 210: joining a lower reinforcing cincture portion 120 to a side wall 21, 22 of the lower tank portion 20, and joining an upper reinforcing cincture portion 110 to a side wall 11, 12 of the upper tank portion 10;

In block 220: mounting the shell-form active part inside the lower tank portion 20;

In block 230: mounting the upper tank portion 10 on the lower tank portion 20 and joining them together by welding the flanges 12 and 22 with a weld seam 30 along the perimetric joining line; and In block 240: joining together the lower reinforcing cincture portion 120 and the upper reinforcing cincture portion 110 to form a sealed chamber 140 enclosing the perimetric joining line and the weld seam 30, for example by applying and welding a belt 130.

Although only a number of particular embodiments and examples have been disclosed herein, it will be understood by those skilled in the art that other alternative embodiments and/or uses of the disclosed innovation and obvious modifications and equivalents thereof are possible. Furthermore, the present disclosure covers all possible combinations of the particular embodiments described. The scope of the present disclosure should not be limited by particular embodiments, but should be determined only by a fair reading of the claims that follow.

The invention claimed is:

1. A tank for a liquid-filled shell transformer or shell reactor, the tank comprising:

a lower tank portion with a bottom plate and lower side walls and an upper tank portion with upper side walls, the lower tank portion and upper tank portion being joined together along a substantially horizontal perimetric joining line and defining an internal space for housing an active part of the shell transformer or shell reactor and an insulating liquid; and the tank comprising a reinforcing cincture surrounding and joined to the lower side walls of the lower tank portion and the upper side walls of the upper tank portion and forming a sealed chamber enclosing the perimetric joining line between the lower tank portion and the upper tank portion, wherein the reinforcing cincture is formed by a lower reinforcing ring surrounding and joined to a horizontal flange of the lower side walls of the lower tank portion, and an upper reinforcing ring surrounding and joined to the upper side walls of the upper tank portion.

2. A tank according to claim 1, wherein the lower tank portion and the upper tank portion are joined together along the perimetric joining line by a weld seam.

3. A tank according to claim 2, wherein the reinforcing cincture has a higher ultimate tensile strength with respect to the ultimate tensile strength that the perimetric weld seam would have if there was no reinforcing cincture between the lower tank portion and the upper tank portion.

4. A tank according to claim 1, wherein the reinforcing cincture is joined to a horizontal flange of the lower side walls of the lower tank portion, and joined to the upper side walls of the upper tank portion, by welding.

5. A tank according to claim 1, wherein the reinforcing cincture comprises a lower reinforcing ring surrounding and joined to a horizontal flange of the lower side walls of the lower tank portion, and an upper reinforcing ring surrounding and joined to the upper side walls of the upper tank portion.

6. A tank according to claim 5, wherein the reinforcing cincture comprises a belt or closing plate joined to the lower reinforcing ring and to the upper reinforcing ring.

7. A tank according to claim 5, wherein the lower reinforcing ring is joined to the lower tank portion by welding.

8. A tank according to claim 5, wherein the upper reinforcing ring is joined to the upper tank portion by welding.

9. A tank according to claim 6, wherein the belt or closing plate is joined to the lower reinforcing ring and to the upper reinforcing ring by welding.

10. A tank according to claim 9, wherein the lower reinforcing ring and the upper reinforcing ring are joined to each other by welding.

11. A tank according to claim 1, wherein the upper tank portion and the lower tank portion are prismatic.

12. A tank according to claim 1 wherein the tank is comprised in a liquid-filled shell transformer or shell reactor.

13. A method for assembling a liquid-filled shell transformer or shell reactor, the method comprising:

providing a lower tank portion and an upper tank portion configured to be joined to each other along a substantially horizontal perimetric joining line, the lower tank portion having a bottom plate and lower side walls and the upper tank portion having upper side walls;

joining a lower reinforcing ring portion to a lower side wall of the lower tank portion, and joining an upper reinforcing ring portion to an upper side wall of the upper tank portion;

mounting an active part of the shell transformer or shell reactor inside the lower tank portion;

mounting the upper tank portion on the lower tank portion and welding them together along the perimetric joining line; and joining together the lower reinforcing ring portion and the upper reinforcing ring portion to form a reinforcing cincture that surrounds the lower side walls and the upper sidewalls in a manner that forms a sealed chamber enclosing the perimetric joining line between the lower tank portion and the upper tank portion, wherein the lower reinforcing ring portion and the upper reinforcing ring portion are comprised in a reinforcing cincture.

14. A method according to claim 13, wherein the method further comprising surrounding and joining the lower reinforcing ring to a horizontal flange of the side walls of the lower tank portion, and surrounding and joining the upper reinforcing ring to the side walls of the upper tank portion.

15. A method according to claim 14, wherein the reinforcing cincture further comprises a belt or closing plate, the method further comprising joining the belt or closing plate to the lower reinforcing ring and to the upper reinforcing ring.

16. A method according to claim 15, wherein joining the belt or closing plate to the lower reinforcing ring and to the upper reinforcing ring comprises joining the belt or closing plate to the lower reinforcing ring and to the upper reinforcing ring by welding.

17. A method according to claim 14, further comprising joining the lower reinforcing ring to the lower tank portion by welding.

18. A method according to claim 14, further comprising joining the upper reinforcing ring to the upper tank portion by welding.

19. A method according to claim 13 wherein the upper tank portion and the lower tank portion are prismatic.

20. A method according to claim 13, further comprising joining the lower tank portion and the upper tank portion together along the perimetric joining line by a weld seam.

* * * * *